US008870405B2

(12) United States Patent
Chung

(10) Patent No.: US 8,870,405 B2
(45) Date of Patent: Oct. 28, 2014

(54) DRAWER ILLUMINATION DEVICE WITH MAGNETIC REED SWITCH

(75) Inventor: Jung-Chang Chung, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 186 days.

(21) Appl. No.: 13/372,157

(22) Filed: Feb. 13, 2012

(65) Prior Publication Data

US 2013/0208455 A1 Aug. 15, 2013

(51) Int. Cl.
*A47B 23/06* (2006.01)

(52) U.S. Cl.
USPC ..... 362/133; 362/155; 362/202; 362/249.05; 362/802

(58) Field of Classification Search
USPC ..... 362/127, 133, 154, 155, 202, 205, 362/249.02, 249.05, 249.12, 802
See application file for complete search history.

(56) References Cited

U.S. PATENT DOCUMENTS

| | | | | | |
|---|---|---|---|---|---|
| 4,178,626 | A * | 12/1979 | Marcus | ..... | 362/133 |
| 4,442,478 | A * | 4/1984 | Stansbury | ..... | 362/489 |
| 5,246,285 | A * | 9/1993 | Redburn et al. | ..... | 362/155 |
| 6,203,167 | B1 * | 3/2001 | Liu et al. | ..... | 362/133 |
| 6,874,924 | B1 * | 4/2005 | Hulse et al. | ..... | 362/551 |
| 6,953,262 | B2 * | 10/2005 | Cleaver et al. | ..... | 362/219 |
| 7,033,040 | B2 * | 4/2006 | Spahr et al. | ..... | 362/155 |
| 7,084,531 | B2 * | 8/2006 | Bruwer | ..... | 307/140 |
| 8,240,891 | B2 * | 8/2012 | Albert et al. | ..... | 362/394 |
| 8,388,172 | B2 * | 3/2013 | Yue et al. | ..... | 362/219 |
| 8,449,139 | B1 * | 5/2013 | Wang | ..... | 362/218 |
| 8,511,849 | B2 * | 8/2013 | Sloan et al. | ..... | 362/224 |
| 2007/0047224 | A1 * | 3/2007 | Lee | ..... | 362/132 |

* cited by examiner

*Primary Examiner* — Ismael Negron
(74) *Attorney, Agent, or Firm* — Muncy, Geissler, Olds & Lowe, P.C.

(57) ABSTRACT

An illumination device includes an elongate rod-shaped lamp having at least one light emitting diode, an electronic module coupled to a power supply device, a magnetic reed switch coupled with the power supply and a magnetic member, the illumination device being configured such that the lamp is turned ON or OFF in response to the magnetic reed switch and the magnetic member approaching or moving away from one another. The illumination device is installed in a drawer of a cabinet to automatically emit light whenever the drawer is opened.

7 Claims, 4 Drawing Sheets

DRAWER ILLUMINATION DEVICE WITH MAGNETIC REED SWITCH

BACKGROUND OF THE INVENTION

1. Field of the Invention

The present invention relates to an illumination device, and more particularly to the illumination device applied in a pull-out cabinet (or a drawer) to provide illuminations to the pull-out cabinet.

2. Description of Related Art

As pull-out or slide drawers (or cabinets) are used extensively in various types of containers or storage apparatuses, such drawers or cabinets have become one of the main storage furniture used at home or in office. In general, the pull-out cabinet comes with drawers of different depths including a smaller depth for desks and a larger depth for cabinets, and the drawers of different depths usually do not come with any illumination function and always rely on ambient light as a light source, so that when the ambient light is weak (or dark), it is relatively difficult to find a desired item in the cabinet. If the environment is very dark or there is no ambient light at all (during in a power failure), users have to find the desired item based on their memory with regard to the position of the object or search the desired item randomly. Obviously, such operation is very inconvenient and time-consuming and even incurs potential risks, such as toppling over a bottle or a can, or getting injured when touching a sharp object. Of course, the larger the cabinet, the more difficult is the search in a poor lighting or unprepared condition. If the ambient light is low or there is no ambient light at all, and objects of the same nature (made of the same material) are stored in the drawer such as a closet or a document cabinet, it is difficult for users to determine the exact position to access the desired item. Obviously, the conventional drawer or cabinet requires improvements.

On the other hand, the drawer of a storage cabinet is mainly used for storing objects, but it also requires illumination or visual effect. In general, a light bulb can be installed easily in the drawer to provide illuminations, but such arrangement causes an inharmonic visual effect, and the application, integrity and safety of storing objects in the drawer of the storage cabinet must be taken into consideration to meet the user requirements. Therefore, it is a main subject for designers and manufacturers of the related industry to overcome the drawbacks of the conventional pull-out cabinet.

In view of the structural design and drawbacks of the conventional pull-out cabinet, the inventor of the present invention conducted extensive researches and experiments, and finally developed a convenient, safe, and visual illumination device of a pull-out cabinet in accordance with the present invention.

SUMMARY OF THE INVENTION

Therefore, it is a primary objective of the present invention to provide an illumination device controlled by a magnetic reed module in a cabinet that can provide an illumination effect automatically when a drawer in the cabinet is pulled out, and a synergic effect of vision and quality of the product can enhance the product competitiveness.

Another objective of the present invention is to maintain the integrity of the using space of the cabinet while providing the illumination function and a convenient and safe way of storing objects in the cabinet or opening/closing the cabinet.

To achieve the aforementioned objectives, the present invention provides an illumination device installed in a cabinet, and the illumination device comprises: a magnetic reed module, further comprising: a magnetic reed switch, installed on the drawer; and a magnetic member, installed in the cabinet and at a corresponding position of the magnetic reed switch; and a lamp, comprising at least one light emitting diode and an electronic module coupled to a power supply device to supply electric power to the light emitting diode, and the power supply device is coupled to the magnetic reed switch, so that the magnetic reed switch and the magnetic member can be contacted with or separated from each other control the ON/OFF of the power supply device, so as to control the light emitting diode to emit light. Therefore, the illumination effect is provided automatically when the drawer is pulled out, and the illumination device of the invention has the synergic effect of vision and quality and provides a safe way of storing objects in the cabinet.

The technical characteristics and effects of the present invention will become apparent with the detailed description of preferred embodiments accompanied with related drawings as follows.

DETAILED DESCRIPTION OF THE PREFERRED EMBODIMENTS

Figure 1:
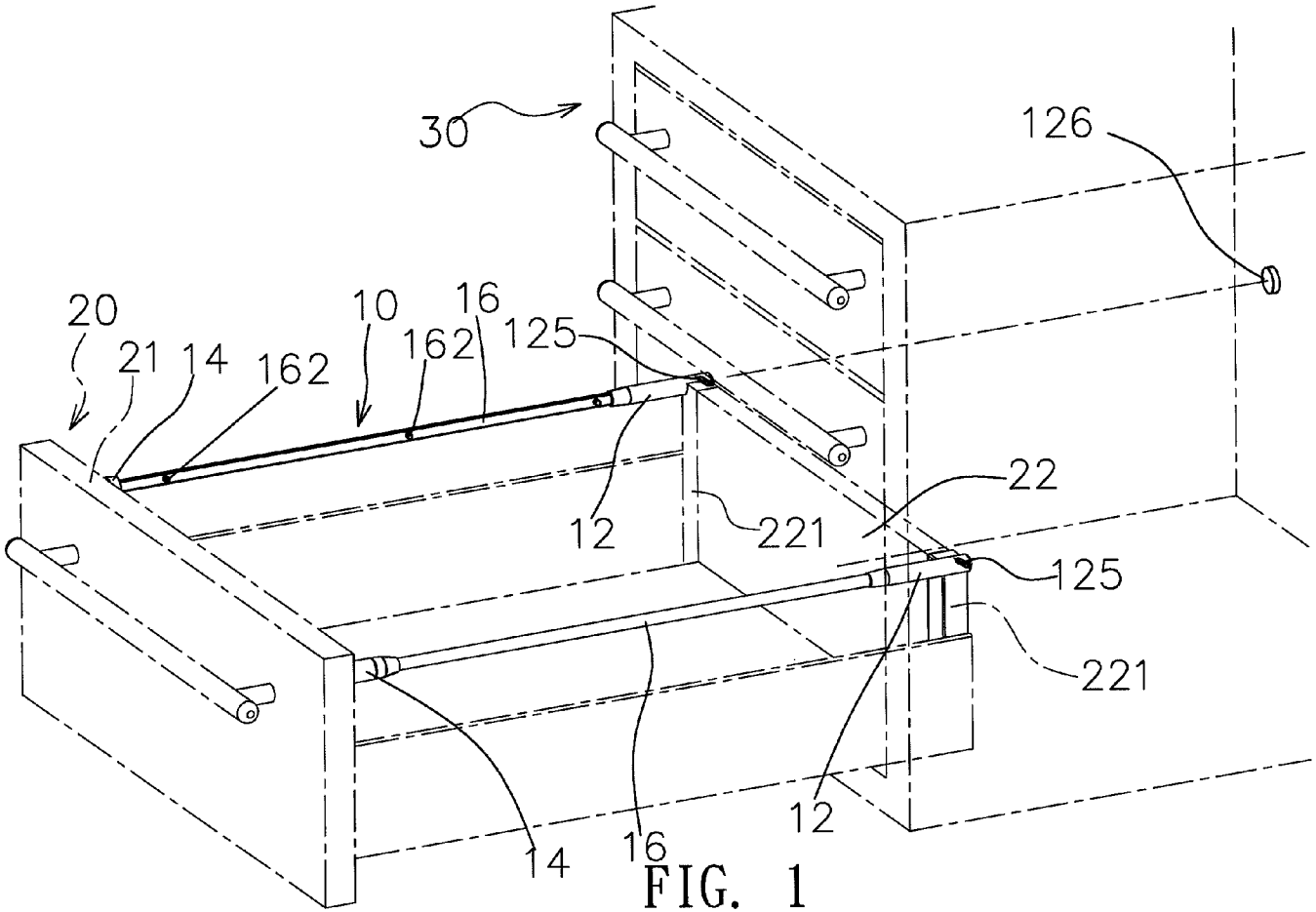
FIG. 1 is a perspective view of assembling the present invention.
Figure 2:
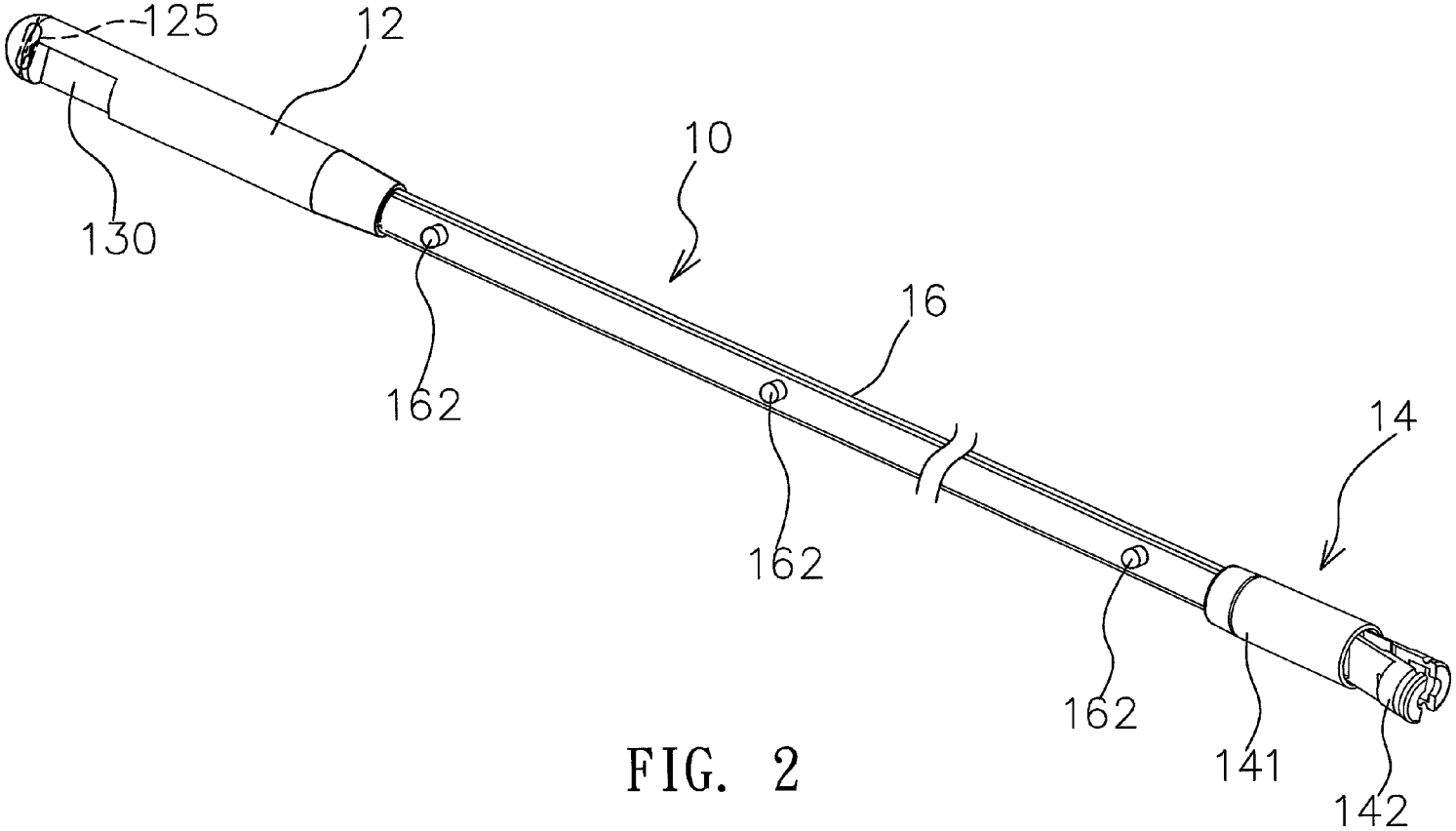
FIG. 2 is a perspective view of the present invention.
Figures 3, 3A, 3B, 3C:
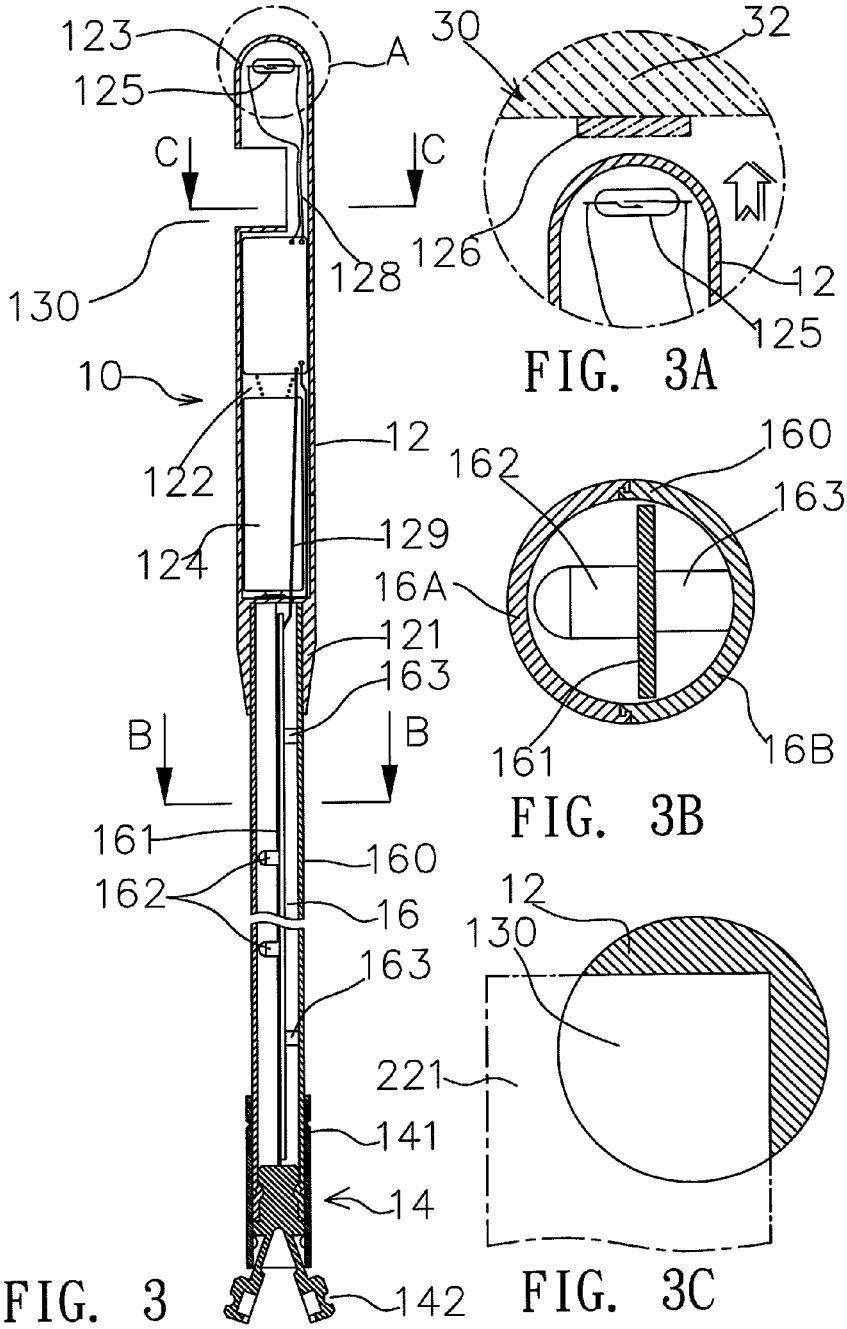
FIG. 3 is a cross-sectional view of the present invention.
FIG. 3A is a schematic view of touching and pressing a magnetic reed switch of the present invention.
FIG. 3B is a cross-sectional view of Section B-B of FIG. 3.
FIG. 3C is a cross-sectional view of Section C-C of FIG. 3.
Figures 4, 4A:
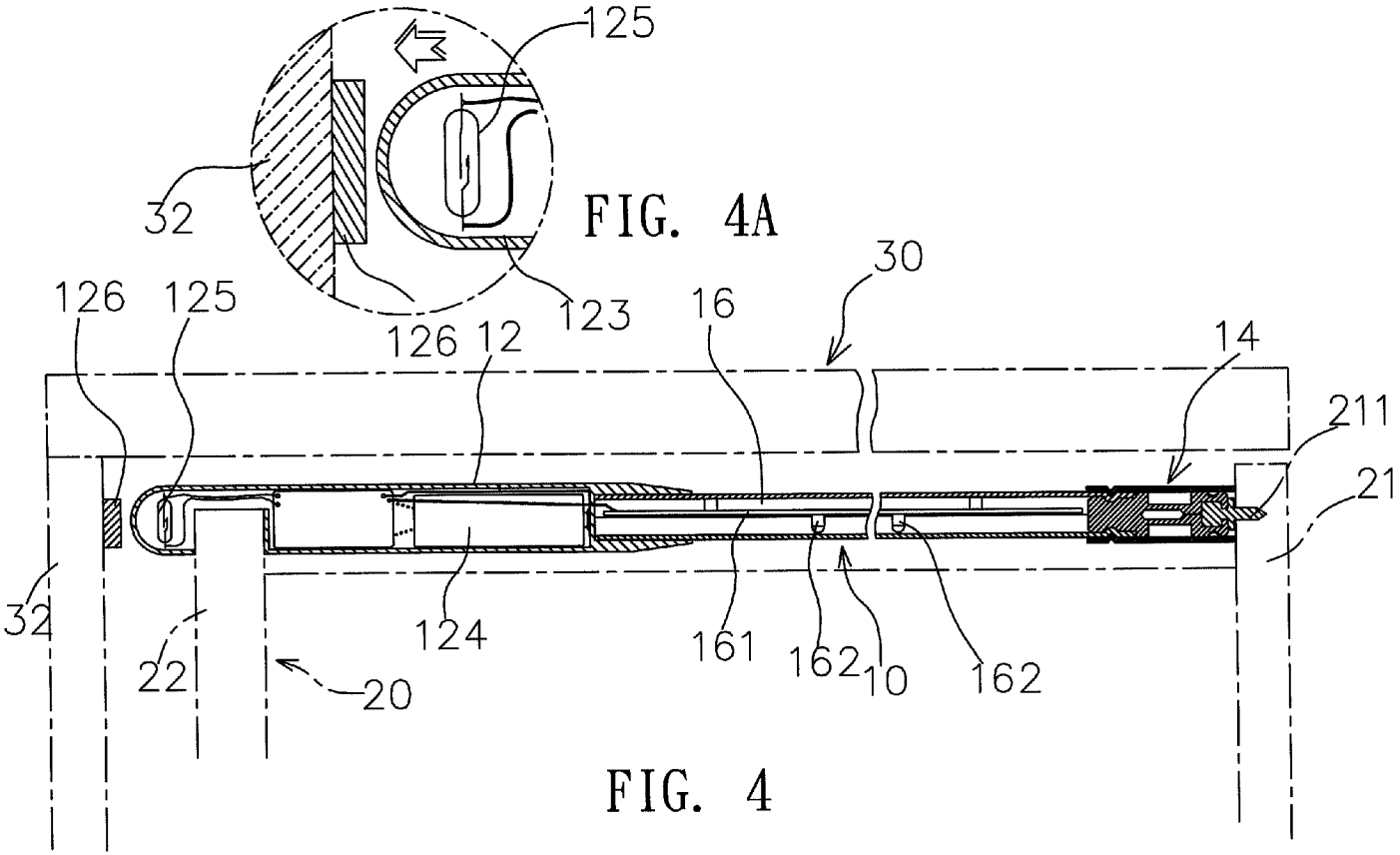
FIG. 4 is a schematic view of operating the present invention.
FIG. 4A is a partial schematic view of operating the present invention.

With reference to FIGS. 1 to 3 for an illumination device 10 presented in an elongated rod shape is installed to a drawer 20, and the drawer 20 is installed in a cabinet 30. In this preferred embodiment, the illumination device 10 with a magnetic reed module 12 is installed at a lateral edge of the drawer 20 and used as a side rod. The illumination device 10 with a magnetic reed module comprises a magnetic reed module 12, a connecting device 14 and a lamp 16. In this preferred embodiment, the magnetic reed module 12 is substantially a tube comprising a connecting portion 121 at the front, a containing space 122 in the middle, and a control unit 123 and a magnetic member 126 at the rear; wherein the connecting portion 121 is provided for connecting the lamp 16, and the containing space 122 is provided for installing a battery 124 (or a power supply device), or a related component module (such as a voltage regulator). However, persons skilled in the art can also install the power supply device outside the illumination device or any other appropriate position), and the control unit 123 comprises a magnetic reed switch 125 coupled to the battery 124 (or the power supply device or voltage regulator) through a power circuit 128. In addition, a connecting notch 130 is formed between the containing space 122 and the control unit 123 and provided for connecting the drawer 20. In other words, the connecting notch 130 is connected to a side pillar 221 of the rear panel 22 (as shown in FIGS. 1 and 3C) wherein the magnetic member 126 is installed on a rear wall 32 of the cabinet 30 (as shown in FIG. 4) and corresponding to the magnetic reed switch 125 (as shown in FIG. 3A). Of course, the foregoing corresponsive relation of the magnetic member and the magnetic reed switch adopted in this preferred embodiment is provided for the purpose of illustrating the present invention only, but not intended for limiting the scope of the invention. Further, the magnetic reed switch 125 and the magnetic member 126 can be contacted with each other or separated from each other to turn on or off the battery 124 respectively, so as to control the lamp 16 to emit light.

The connecting device 14 is coupled to the lamp 16, and a connecting portion 141 reciprocally movable and sheathed on the external periphery of the connecting device 14, and a split rod portion 142 is disposed at a front end of the connecting device 14 and coupled with the front panel 21 of drawer 20 by clamping. In other words, the split rod portion 142 can be engaged and clamped onto a connecting element 211 of the front panel 21 (as shown in FIG. 4), and then the connecting portion 141 is pushed forward and covered onto the split rod portion 142.

In this preferred embodiment, the lamp 16 comprises a tube 160 (such as an illumination tube) coupled between the magnetic reed module 12 and the connecting device 14, which is coupled to the connecting portions 121, 141, and the tube 160 can be wholly or partially designed with a transparent or semi-transparent effect, so that the tube is transparent. In a preferred embodiment, the tube 160 is comprised of an illumination tube 16A and a back tube 16B (as shown in FIG. 3B), and the illumination tube 16A is transparent, and the illumination device 10 with the magnetic reed module further comprises an electronic module 161 installed in the tube 160, and the electronic module 161 comprises a plurality of light emitting diodes 162 (LED lamps) installed thereon, and the light emitting diodes 162 (LED lamps) correspond to the illumination tube 16A, and the electronic module 161 includes a plurality of press pillars 163 disposed at the back of the electronic module 161 for abutting and securing the tube 160 (or the back tube 16B). In addition, the electronic module 161 is coupled to the battery 124 (or a power supply device or a voltage regulator) through a power circuit 129.

With reference to FIGS. 4 and 4A for the operation of the present invention, when the drawer 20 is pulled to the front and opened, the magnetic reed switch 125 of the control unit 123 is moved forwardly together with the rear panel 22. Now, the magnetic reed switch 125 is situated at a position away from the magnetic member 126 on the rear wall 32 of the cabinet 30, and the magnetic reed switch 125 produces an electric conduction to drive the light emitting diode 162 (or LED lamp) to emit light, and the light emitted from the light emitting diode 162 (or LED lamp) passes through the tube 160 (or the illumination tube 16A) to illuminate the interior of the drawer 20, so as to provide an illumination function. When the drawer 20 is pushed backward and closed, the magnetic reed switch 125 of the control unit 123 is moved backward with the rear panel 22. Now, the magnetic reed switch 125 approaches the magnetic member 126 on the rear wall 32 of the cabinet 30, such that the magnetic reed switch 125 disconnects the power (or turns off the power supply), and the light emitting diode 162 (or LED lamp) no longer emits light. Since the drawer 20 is closed at the time, therefore there is no need for the light emitting diode 162 (or LED lamp) to emit light, and such arrangement can avoid wasting unnecessary electric energy. With the present invention, the illumination function is provided whenever the drawer 20 is opened. Obviously, the invention is practical and convenient. In addition, the present invention adopts the light emitting diode 162 (or LED lamp) as a light source, and the illumination device of this preferred embodiment is installed at a lateral edge of the drawer 20 and used as a side rod, without affecting the usable space inside the drawer 20 or affecting the aesthetic look. The invention even improves the overall visual effect, without affecting the movement or operation of the drawer 20 or causing any risk or danger of the use.

With the aforementioned components and structure, the present invention can overcome the drawbacks of the illumination of the conventional drawers and improve the quality of the illumination device with a synergic visual effect, so that the cabinet and drawer maintains the using space while providing the illumination function and a safe way of storing objects in the cabinet and opening/closing the cabinet.

What is claimed is:

1. An illumination device comprising:

a cabinet with at least one drawer, the drawer comprising a front panel, a rear panel, two lateral side panels;

a magnetic reed module, with an elongated tubular body, set in the backend of the drawer, combined with the drawer rear panel, comprising:

a magnetic reed switch, installed on the drawer; and a magnetic member, installed in the cabinet and at a corresponding position of the magnetic reed switch;

a lamp, comprising at least one light emitting diode and an electronic module coupled to a power supply device to supply electric power to the light emitting diode, and the power supply device being coupled to the magnetic reed module and used to control turning ON/OFF the power supply device, so as to control the light emitting diode to emit light; and a connecting device, with one end connected with the lamp, the other end combined with the drawer front panel.

2. The illumination device as recited in claim 1, wherein the magnetic reed module further comprises a containing space for containing the power supply device.

3. The illumination device as recited in claim 1, wherein the power supply device is a battery.

4. The illumination device as recited in claim 1, further comprising a tube for installing the electronic module.

5. The illumination device as recited in claim 4, wherein the tube is comprised of an illumination tube and a back tube, and the illumination tube is transparent, and the illumination tube is corresponsive to the light emitting diode.

6. The illumination device as recited in claim 4, wherein the electronic module comprises at least one press pillar disposed at the backside of the electronic module for abutting and securing the tube.

7. The illumination device as recited in claim 4, wherein the illumination device is installed on a lateral edge of the drawer and used as a side rod of a drawer.

* * * * *